US011168469B2

(12) United States Patent
Rathammer

(10) Patent No.: US 11,168,469 B2
(45) Date of Patent: Nov. 9, 2021

(54) ARRANGEMENT FOR THE INSTALLATION AND WALL MOUNTING OF A WASH BASIN OR THE LIKE

(71) Applicants: Andre Rathammer, Österreich (AT); Harald Fechter, Österreich (AT)

(72) Inventor: Andre Rathammer, Österreich (AT)

(73) Assignees: Andre Rathammer, Österreich (AT); Harald Fechter, Österreich (AT)

( * ) Notice: Subject to any disclaimer, the term of this patent is extended or adjusted under 35 U.S.C. 154(b) by 56 days.

(21) Appl. No.: 16/338,533

(22) PCT Filed: Oct. 2, 2017

(86) PCT No.: PCT/EP2017/074957
§ 371 (c)(1),
(2) Date: Apr. 1, 2019

(87) PCT Pub. No.: WO2018/065355
PCT Pub. Date: Apr. 12, 2018

(65) Prior Publication Data

US 2019/0226188 A1 Jul. 25, 2019

(30) Foreign Application Priority Data

Oct. 4, 2016 (AT) ..... A 50895/2016

(51) Int. Cl.
*E03C 1/322* (2006.01)
*E03C 1/02* (2006.01)

(52) U.S. Cl.
CPC ..... *E03C 1/322* (2013.01); *E03C 1/021* (2013.01)

(58) Field of Classification Search
CPC ..... E03C 1/322; E03C 1/021
USPC ..... 4/695
See application file for complete search history.

(56) References Cited

U.S. PATENT DOCUMENTS 7,204,267 B1 * 4/2007 Persico ..... E03C 1/021 137/357
9,021,620 B1 * 5/2015 Walker ..... E03C 1/322 4/252.2
2003/0005517 A1 1/2003 Randolph
2012/0273064 A1 11/2012 Ismert et al.
(Continued)

FOREIGN PATENT DOCUMENTS

DE 28 37 710 A1 3/1979
DE 87 14 318.6 U1 4/1988
(Continued)

*Primary Examiner* — Christine J Skubinna
(74) *Attorney, Agent, or Firm* — Carmody Torrance Sandak & Hennessey LLP

(57) ABSTRACT

The invention relates to an arrangement for the installation and wall mounting of a washbasin (23) or the like, wherein a flush-mounted box (1) for connections of the washbasin (23) and a fastening device for the fastening of the washbasin (23) on the wall are provided, wherein the flush-mounted box (1) comprises a load-bearing rear wall (2) provided with a mounting rail (4), which can be fixedly anchored to the wall (24), wherein the rear wall bears the fastening device (5) for the washbasin (23), wherein the flush-mounted box (1) comprises the connections for the water inlet (6, 7) and the drain (30) and wherein the front side of the flush-mounted box (1) is entirely covered by the rear wall (31) of the washbasin (23) once it has been mounted on the wall.

8 Claims, 5 Drawing Sheets

(56) References Cited

U.S. PATENT DOCUMENTS

| | | | | |
|---|---|---|---|---|
| 2015/0000019 | A1 | 1/2015 | Connell | |
| 2018/0347171 | A1* | 12/2018 | Connell | E03D 11/16 |

FOREIGN PATENT DOCUMENTS

| | | | |
|---|---|---|---|
| DE | 87 14 318 | U1 | 4/1988 |
| DE | 10016911 | A1 | 10/2001 |
| DE | 201 07 038 | U1 | 8/2002 |
| DE | 10146874 | C1 | 10/2002 |
| DE | 10222932 | C1 | 11/2003 |
| DE | 20 2007 014 808 | U1 | 3/2009 |
| DE | 20 2008 002 171 | U1 | 6/2009 |
| DE | 20 2014 104 220 | U1 | 9/2014 |
| EP | 0 864 701 | A2 | 9/1998 |
| EP | 1936045 | A1 | 6/2008 |
| EP | 2 136 007 | A2 | 12/2009 |
| EP | 2136007 | A2 | 12/2009 |
| EP | 2 394 550 | A2 | 12/2011 |
| EP | 2394550 | A2 | 12/2011 |
| JP | 2008291456 | | 12/2008 |

* cited by examiner

ARRANGEMENT FOR THE INSTALLATION AND WALL MOUNTING OF A WASH BASIN OR THE LIKE

BACKGROUND OF THE INVENTION

The present invention relates to an arrangement for the installation and wall mounting of a washbasin or the like, wherein a flush-mounted box for connections of the washbasin and a fastening device for the fastening of the washbasin on the wall are provided.

Arrangements of this kind serve to mount washbasins or similar devices as easily, fast and cost-efficiently as possible on the wall and to provide the necessary connections for the water inlet and outlet. The washbasins known to this date have the disadvantage that their mounting is relatively complex and that the fittings arranged underneath the washbasin such as connection taps, inlet and outlet hoses, siphon etc. are freely visible and therefore visually unattractive.

The provision of separate covers or covers connected to the washbasin for the wall connections and the siphon of the outlet is known. These covers require either specially designed vanity units or convex portions at the bottom of the washbasin, which make the washbasins very bulky and heavy. The mounting of the washbasins consists of a whole series of steps and is cumbersome.

The object of the present invention is to provide a washbasin without the above mentioned disadvantages. In particular, the object is to hide the connections of the washbasin without additional cover elements. This concerns not only the water inlet connections, but also the drain. The object is also to avoid the use of additional materials such as extension hoses, separate siphons etc., which are otherwise necessary for the mounting. Another object is not to obstruct the provision of vanity units underneath washbasins by the connections. A further object is to provide accessibility to the disabled and to make vandalism more difficult.

The basic idea of the invention is that any connections are covered by the washbasin. The invention is in particular characterized in that the flush-mounted box comprises a load-bearing rear wall provided with a mounting rail, which can be fixedly anchored to the wall, wherein the rear wall bears the fastening device for the washbasin, that the flush-mounted box comprises the connections for the water inlet and drain and that the front side of the flush-mounted box is entirely covered by the rear wall of the washbasin once it is fastened on the wall.

The fastening device preferably consists of screw bolts, which are fixedly connected to the rear wall of the flush-mounted box or to the mounting rail, and which protrude from the wall and are provided flush with mounting holes of the washbasin.

Furthermore, the water connections with their stopcocks and connection fittings for the water fittings are preferably incorporated in their entirety into the flush-mounted box and the water fittings can be connected via one or more flexible hose(s).

The water drain is preferably a flush-mounted siphon, the siphon head of which is arranged inside the flush-mounted box with its closable access opening.

The siphon head may comprise a self-sealing insertion sleeve for receiving an outlet pipe arranged in the washbasin.

In addition to other features of the invention, the washbasin comprises at least one, preferably two, recesses, which are accessible from the outside and are directly adjacent to the mounting holes. The mounting rail may be fixedly connectable to the wall and may be designed for connection to a lightweight wall with perpendicular wall supports in such a way that its ends can be fastened on both sides in or adjusted to wall supports.

A particular advantage of the construction according to the invention is that it can be mounted quickly. This is especially advantageous if a plurality of equal washbasins has to be mounted, e.g. in a big residential or hotel complex. Thanks to the fast mounting of the washbasins according to the invention significant cost savings are possible. No boreholes are required for the mounting so that the risk of puncturing lines is avoided. The mounting can be carried out by a worker.

BRIEF DESCRIPTION OF THE DRAWINGS

In the following, the invention is explained in more detail with reference to the figures.

DETAILED DESCRIPTION OF THE PREFERRED EMBODIMENTS

Figure 1:
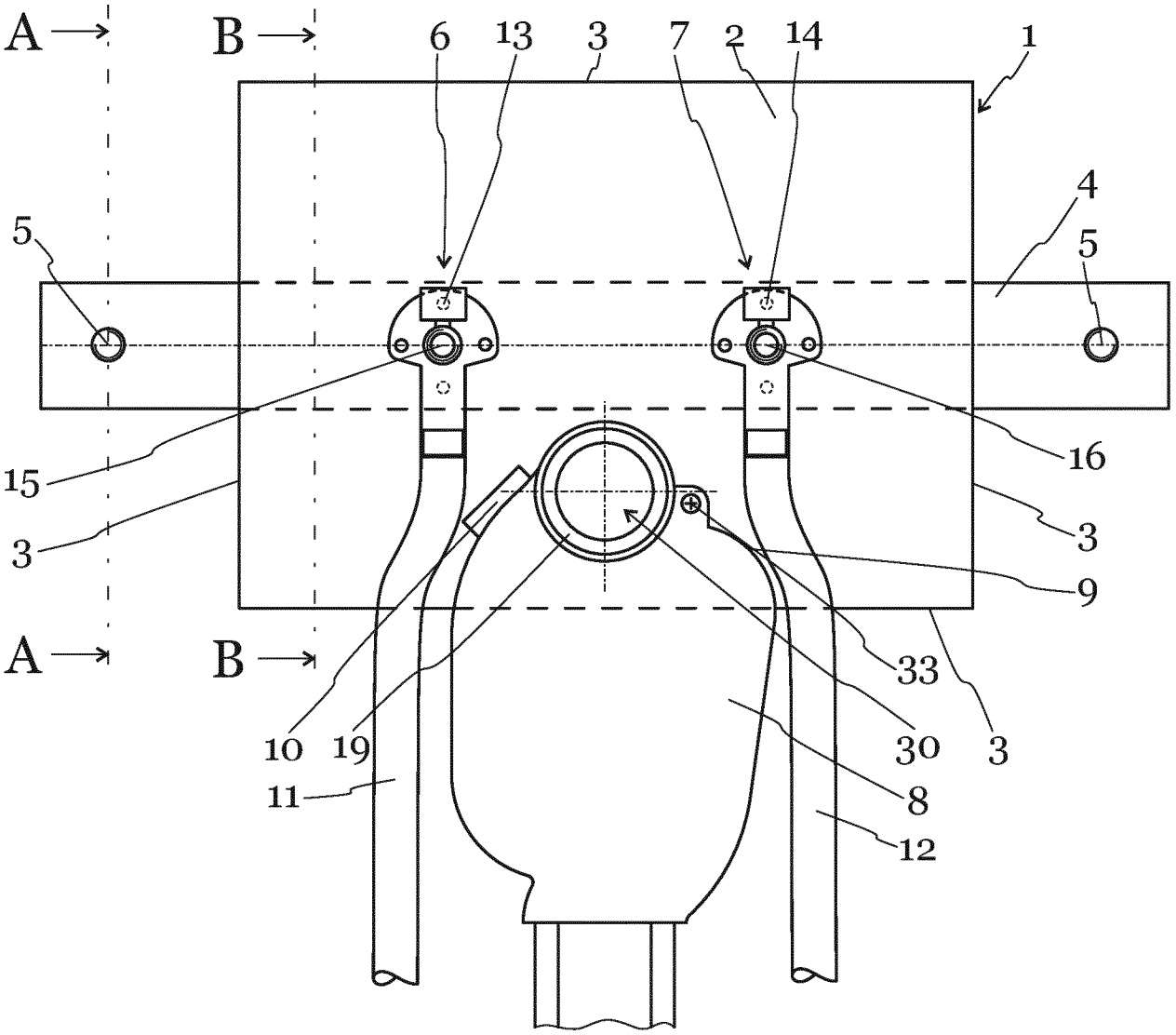
FIG. 1 is a front view of the arrangement which is built or can be built into a wall.

FIG. 1 shows the installation part of the invention, which is to be connected to the wall or which is fixedly connected thereto. The flush-mounted box 1 comprises a load-bearing rear wall 2 and is preferably surrounded by an upper, a lower and two lateral side walls 3 in order to define a free space. A mounting rail 4 is fixed to the back of the rear wall 2. The mounting rail 4 protrudes beyond the rear wall 2 on both sides and the mounting rail 4 bears fastening bolts 5 which are fixedly connected to it. On the rear wall 2 the water connections 6, 7 are arranged and a flush-mounted siphon 8 is provided, the siphon head 9 of which protrudes into the cavity of the flush-mounted box 1, where it can be accessed. In order to clean the siphon 8, which is sometimes necessary, its access opening 10 is also arranged inside the flush-mounted box 1. The screw 33 connects the siphon 8 to the rear wall 2.

FIG. 1 is intended to show that the flush-mounted box 1 is built into the wall together with its mounting rail 4 and the lower part of the siphon 8 or, in the case of lightweight walls, is laterally covered by cover panels 22 towards the front. In all cases, the front opening of the flush-mounted box 1 is left open during the installation.

The water inlet pipes 11, 12 are the water-conducting pipes, from which the inlet pipes to the water fittings, which are not shown in FIG. 1, are supplied with the water when the cocks 13, 14 are opened. The connection fittings bear reference numbers 15, 16. In part, the water inlet pipes are only indicated by dashed lines.

Figure 4:
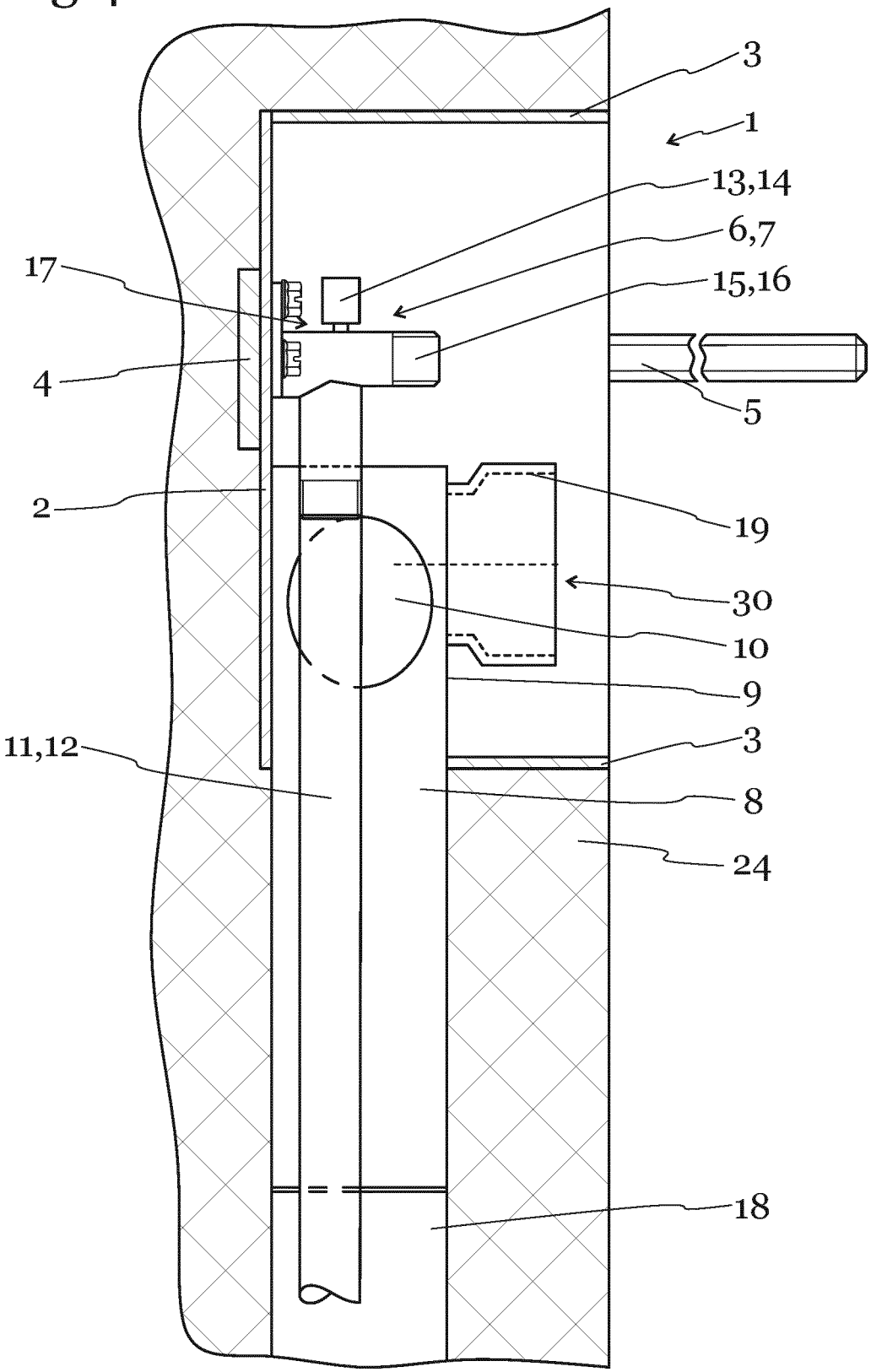
FIG. 4 is a section according to line B-B in FIG. 1, wherein the washbasin is not yet in place.

FIG. 4 shows the section according to line B-B in FIG. 1, wherein the flush-mounted box 1 has been installed in a solid wall. FIG. 4 shows clearly that the water inlet pipes 11, 12 are guided to the water connections 6, 7 with the cocks 13, 14 from the inside of the wall. It can further be seen that the fastening device protrudes as screw bolts 5 out of the wall to the front, wherein the length of the screw bolts 5 depends on how far the associated washbasin 23 can be pulled away from the wall without disengaging the bolt.

Furthermore, it can be seen that the siphon 8 is built into the wall in in its lower part and connected to the discharge pipe 18, while the siphon head 9 protrudes upwards into the inner space of the flush-mounted box 1. Through the access opening 10, the siphon 8 can be maintained and cleaned, if necessary. The insertion sleeve 19 serves for the sealing reception of an outlet pipe 32 connected to the washbasin 23.

Figure 2:
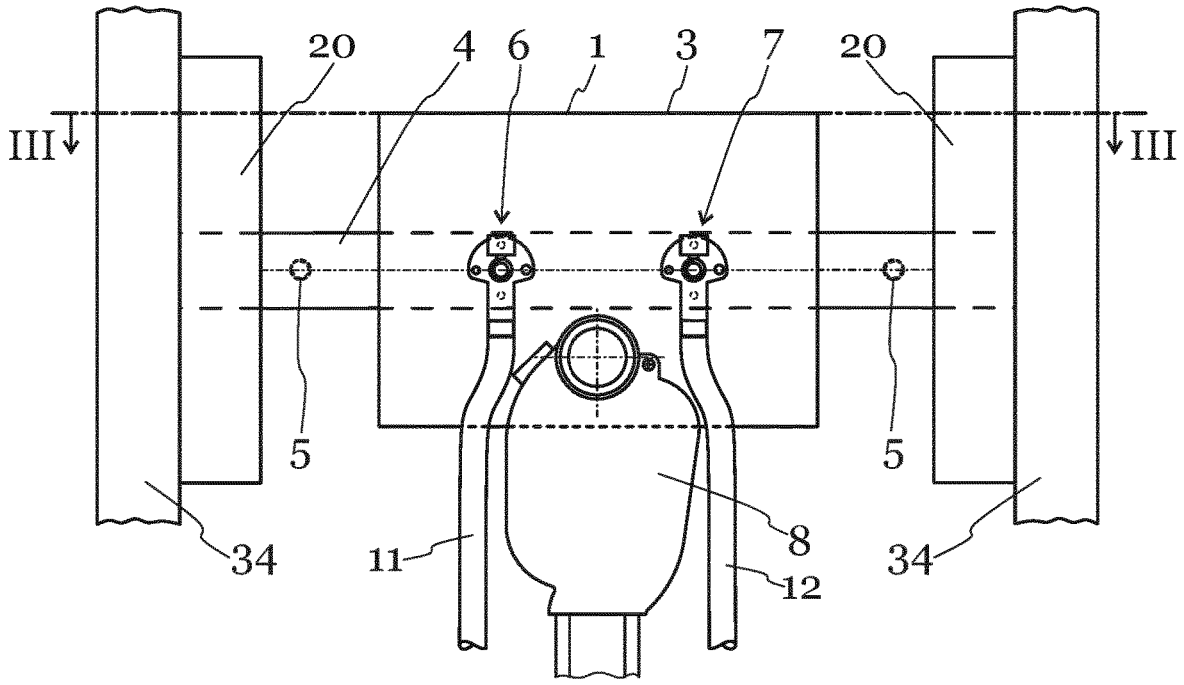
FIG. 2 shows the same arrangement between the supports of a lightweight wall.
Figure 3:
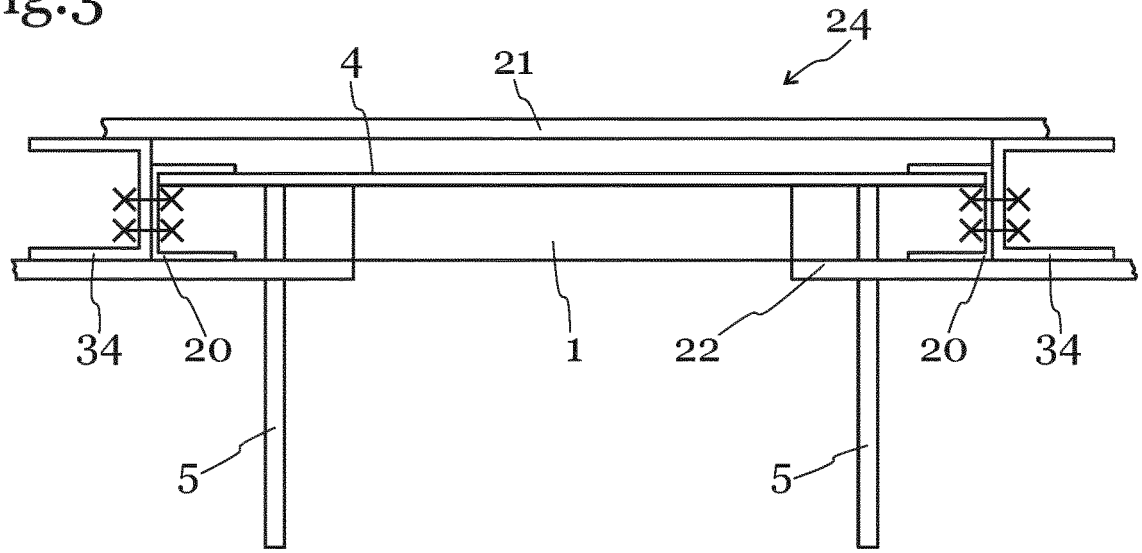
FIG. 3 shows a section according to Ill-Ill in FIG. 2 in the built-in state.

The FIGS. 2 and 3 show the installation situation in the case of lightweight walls, wherein the mounting rail 4 is connected at its outer ends to perpendicularly arranged fastening profiles 20. The fastening profiles 20 serve for the secure fastening on perpendicular wall supports 34, which are part of the lightweight wall. The inlet and outlet pipes and the fastening profiles with the mounting rail 4 are covered towards the exterior by means of the cover panels 21, 22, which can be gypsum panels or the like, while the front opening of the flush-mounted box 1 remains open.

Figure 5:
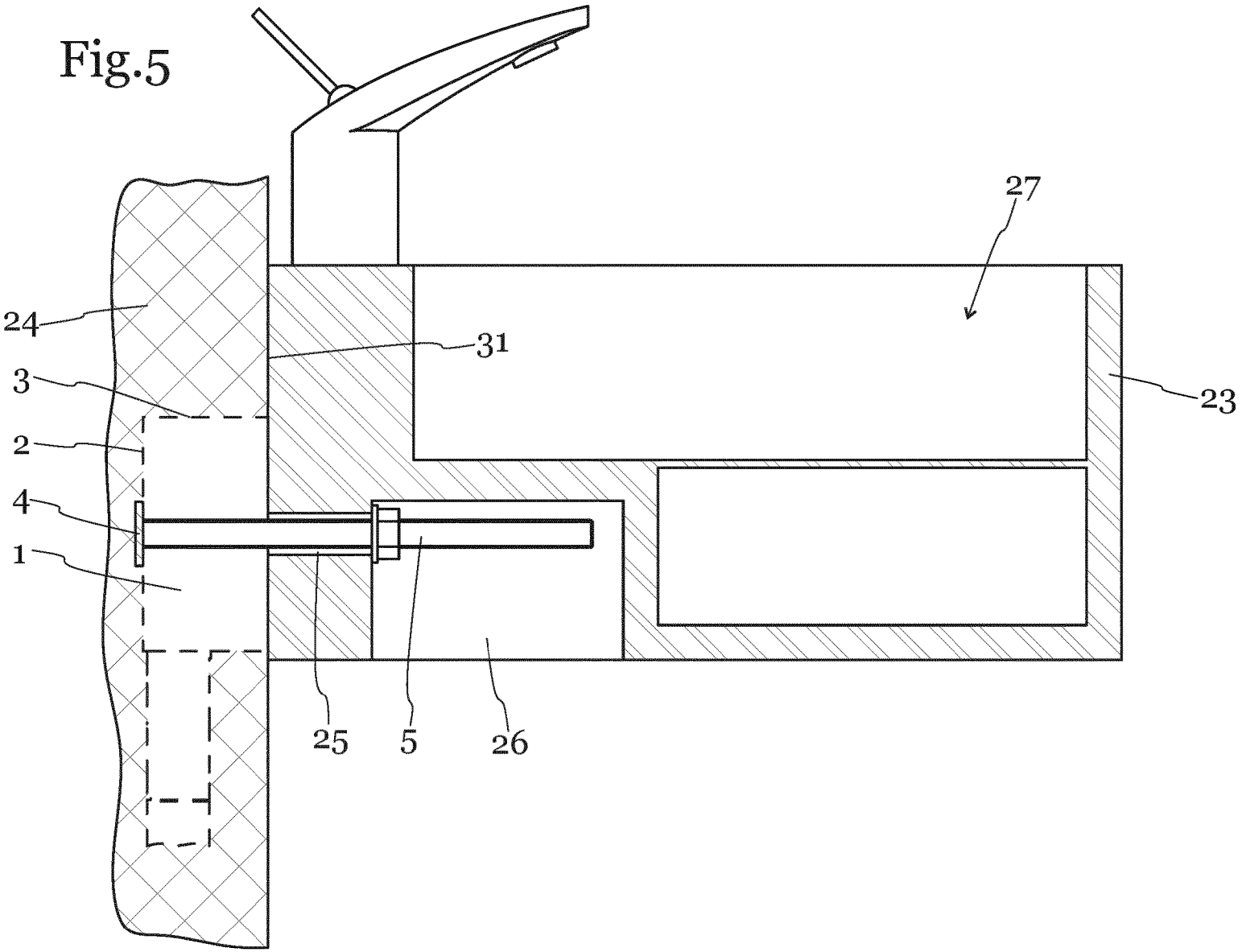
FIG. 5 shows a section according to line A-A in FIG. 1, wherein the washbasin is in place and mounted.
Figure 6:
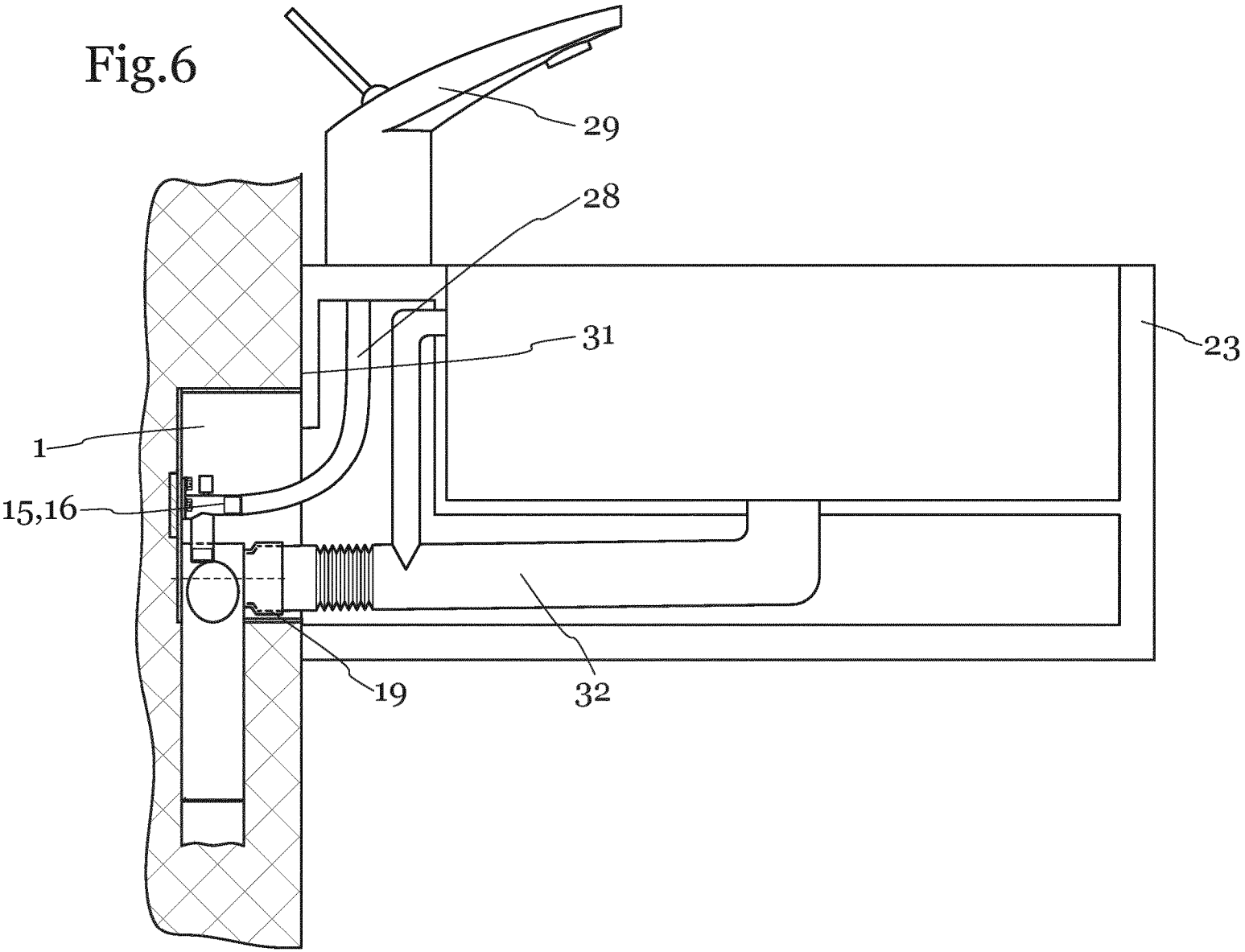
FIG. 6 shows a cross-section of the arrangement, wherein the washbasin is mounted and the inlet and outlet pipes are made visible.

FIGS. 5 and 6 show the arrangement according to the invention in the assembled state, wherein also the washbasin 23 is completely connected and mounted.

FIG. 5 shows the arrangement for fastening the washbasin 23 on the wall 24, wherein the washbasin 23 comprises mounting holes 25 and recesses 26 directly adjacent thereto. The water-receiving portion of the washbasin 23 bears reference numeral 27. The washbasin 23 is preferably built symmetrically so that for each of the screw bolts 5 a recess 26 is provided, which advantageously allows the screw nut to be accessed and actuated from below.

The washbasin 23 is easily fastened by sliding the washbasin 23 with its mounting holes 25 over the fastening bolts 5 against the wall and positioning it by tightening the screw nuts. The washbasin 23 can be easily dismantled by opening the screw nuts and sliding the washbasin 23 off of the fastening bolt 5.

FIG. 6 shows the arrangement in the area of the water and wastewater connections. The water supply is realised by means of flexible hoses 28 which extend from the connection fitting 15, 16 to the respective port at the water fitting 29. In the water basin 23 the outlet pipe 32 is provided, which can be sealingly inserted into the insertion sleeve 19 via a flexible hose with a rigid insertion part in a sliding manner, when the washbasin 23 is slid against the wall over the screw bolts 5.

The scope of the invention leaves room for additions and variations of the embodiments shown in the figures. It may, for example, be advantageous to provide the rear wall 2 and/or the mounting rail 4 with claws or anchors for increasing the adherence to the wall. Instead of the screw bolts 5 threaded bars or bars may be provided, on which screw nuts or clamping elements can be clamped. The load-bearing rear wall 2 and the mounting rail 4 must be sufficiently stable in order to be able to support the washbasin 23. The side walls 3 may be made of plastic or thin sheet, as their sole purpose is to define the inner space of the flush-mounted box 1 during the installation into the wall.

The water connections 6, 7 can also be mounted rotated by 180°, for example, to facilitate the water supply from above. In case the fastening is performed on wall supports 34, the mounting rail 4 is preferably welded or screwed thereto.

Parts that are not essential for the invention, such as the outlet fitting between the water-receiving portion 27 and the outlet pipe 32 are not shown.

REFERENCE LIST

1 Flush-mounted box
2 Rear wall
3 Side wall
4 Mounting rail
5 Fastening bolt
6 Water inlet
7 Water inlet
8 Flush-mounted siphon
9 Siphon head
10 Access opening
11 Water inlet pipe
12 Water inlet pipe
13 Cock
14 Cock
15 Connection fitting
16 Connection fitting
17 . . .
18 Discharge pipe
19 Insertion sleeve
20 Fastening profiles
21 Cover panel
22 Cover panel
23 Washbasin
24 Wall
25 Mounting hole
26 Recess
27 Water-receiving portion
28 Flexible hoses
29 Water fitting
30 Water drain
31 Rear wall
32 Outlet pipe
33 Screw
34 Wall supports

The invention claimed is:

1. An arrangement for the installation and wall mounting of a washbasin, the arrangement comprising:

a box for connections of the washbasin and a fastening device for the fastening of the washbasin on a wall, wherein the box comprises:

a rear wall provided with a mounting rail, which can be fixedly anchored to a wall, wherein the rear wall bears the fastening device for the washbasin, connections for a water inlet and a water drain and wherein a front side of the box is entirely covered by a rear wall of the washbasin the washbasin is mounted on the wall; and wherein the fastening device comprises screw bolts, which are permanently connected to the rear wall of the box or to the mounting rail, which, prior to mounting the washbasin, extend through the box and out the front side of the box, and which, prior to mounting the washbasin, protrude from the wall to which the washbasin is secured, and which screw bolts are provided flush with mounting holes of the washbasin.

2. The arrangement as claimed in claim 1, further comprising connection fittings for a plurality of water fittings, wherein the connection fittings are positioned in the flush-mounted box and the water fittings can be connected via one or more flexible hose(s).

3. The arrangement as claimed in claim 1, wherein the water drain is a siphon comprising a siphon head, wherein the siphon head is arranged with its closable access opening inside the box.

4. The arrangement as claimed in claim 3, wherein the siphon head comprises a self-sealing insertion sleeve for receiving an outlet pipe arranged in the washbasin.

5. The arrangement as claimed in claim 1, wherein the washbasin comprises at least one recess adjacent to the mounting holes.

6. The arrangement as claimed in claim 1, wherein the mounting rail is connected to the wall.

7. The arrangement as claimed in claim 1, wherein ends of the mounting rail are fastened on both sides in or on the wall supports.

8. The arrangement as claimed in claim 1, further comprising stopcocks for the water fittings, wherein the stopcocks are positioned in the box.

* * * * *